United States Patent [19]

Wake

[11] 4,323,002

[45] Apr. 6, 1982

[54] HYDRAULIC EQUIPMENT

[75] Inventor: Malcolm Wake, Wakefield, England

[73] Assignee: Fletcher Sutcliffe Wild Limited, West Yorkshire, England

[21] Appl. No.: 150,900

[22] Filed: May 16, 1980

Related U.S. Application Data

[63] Continuation of Ser. No. 919,291, Jun. 26, 1978, abandoned.

[30] Foreign Application Priority Data

Aug. 10, 1977 [GB] United Kingdom ..... 33607/77

[51] Int. Cl.[3] ..... F15B 15/22; F15B 15/26

[52] U.S. Cl. ..... 91/25; 91/31; 91/402; 92/23; 92/29; 92/52

[58] Field of Search ..... 91/167 R, 402, 168, 91/25, 31; 92/51, 142, 23, 53, 29, 52

[56] References Cited

U.S. PATENT DOCUMENTS 1,248,861 12/1917 Holloway ..... 92/23

3,452,647 7/1969 Herrell ..... 92/53

3,818,805 6/1974 Johansson ..... 91/402

3,904,416 9/1975 Onoda ..... 91/167 R

FOREIGN PATENT DOCUMENTS 73404 9/1916 Austria ..... 92/23

*Primary Examiner*—Paul E. Maslousky

*Attorney, Agent, or Firm*—Lowe, King, Price & Becker

[57] ABSTRACT

A hydraulically actuable piston and cylinder unit comprising a hollow piston rod, slidably housing, at least partially, an elongate extension piece having a circular outer periphery, means to connect mechanically, the extension piece to the piston rod at the outer end of the latter remote from the piston head, at least one fluid passageway communicating between the annulus side of the piston head and the hollow interior of the piston rod, and a fluid seal carried by the extension piece and sealing against the internal periphery of the hollow piston rod, the arrangement being such that the seal always lies between the passageway and the outer end of the hollow piston rod.

4 Claims, 2 Drawing Figures

HYDRAULIC EQUIPMENT

Figure 1:
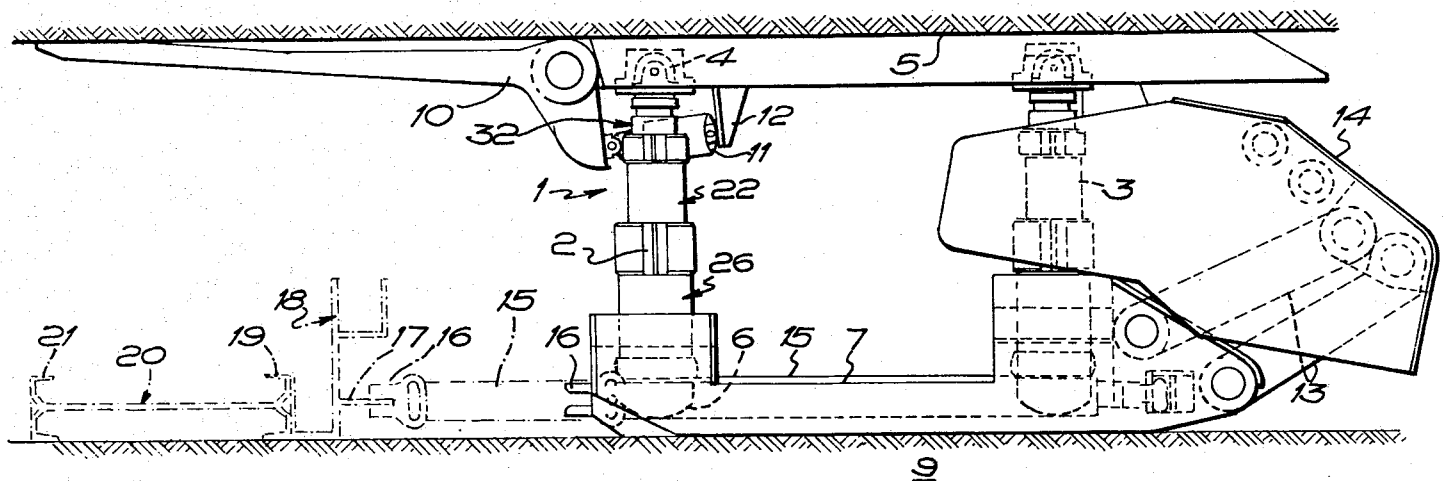

This is a continuation of application Ser. No. 919,291 filed June 26, 1978, now abandoned.

This invention relates to hydraulically actuable piston and cylinder units adapted to serve a mine roof supporting function and usually incorporated with at least one similar unit both serving as extensible chock legs in a hydraulically powered self-advancing mine roof support, as is commonly employed in association with an armoured scraper chain conveyor, along a mineral e.g. coal face. Other uses of such units are for instance, in conveyor anchor stations.

It is known for such mining techniques that the thickness of the mineral seam involved dictates to a large extent the maximum extension required to be performed in service by such units. However, to make a given unit more adaptable for a greater range of seam thicknesses, it is known to provide such units with mechanical extension pieces which are usually adjustable as to their degree of extension. One known extension piece comprises a tubular member adapted to fit at least partially within a hollow piston rod of a piston and cylinder unit, the member being provided with a plurality of axially spaced annular peripheral grooves, a selected one of which is adapted to be engaged by a collar carried by the piston rod to preset the degree of mechanical extension. Adjustment of the degree of extension however, involves the removal, at least partially, of the collar and the manual displacement, or control of displacement inwards or outwards of the extension piece which may well weigh several hundred pounds, until a fresh annular groove is aligned accurately with a collar and the latter re-applied. This is not a straight forward operation under mining conditions, expecially if as is usually the case, the unit carries at its upper end a roof bar or more particularly, one end of an elongate roof bar, the mine roof remaining unsupported all the while such adjustment is being effected.

According to the present invention, a hydraulically actuable piston and cylinder unit comprises a hollow piston rod, slidably housing, at least partially, an elongate extension piece having a circular outer periphery, means to connect mechanically, the extension piece to the piston rod at the outer end of the latter remote from the piston head, at least one fluid passageway communicating between the annulus side of the piston head and the hollow interior of the piston rod, and a fluid seal carried by the extension piece and sealing against the internal periphery of the hollow piston rod, the arrangement being such that the seal always lies between the passageway and the outer end of the hollow piston rod.

Thus, with the piston and cylinder unit, according to the invention, in the retracted condition, then upon release of the means mechanically connecting the extension piece to the hollow piston rod, pressurisation of the annulus side of the piston head (side closest the outer end of said piston rod) and the consequent transfer of pressure fluid through the passageway has the effect of displacing the extension piece outwardly with respect to the hollow piston. Conversely, release of pressure from the annulus side causes retraction of the extension piece, for in service, the unit is normally located in a vertical position, or substantially so, the extension piece thereby retracting under its own weight. Extension or retraction is continued as required efficiently lengthening or shortening the effective length of the piston rod and the mechanical connection means re-applied, whereupon the unit is again ready for use.

Preferably, the extension piece is hollow, with an open inner end and a plugged outer end. The passageway from the annulus side of the piston head to the interior of the piston may be located beyond the lowermost point of entry of the extension piece but if not, a passageway may be provided in the extension piece communicating between its exterior and interior for fluid inlet and exhaust purposes. Preferably the mechanical connection means between the cylinder and the extension piece comprises a plurality of axially spaced, annular, outer peripheral grooves provided on the extension piece and a collar, which is split for attachment-/detachment purposes, with an inward projecting flange adapted to engage in a selected peripheral groove, the collar being removably secured e.g. by bolts to the outer end of the piston rod.

If it is required to ensure that the extension piece is not accidentally extended completely out of the hollow piston rod, the latter, towards its outer end, may be of enlarged internal diameter, by being tapered or stepped, to an extent such that the seal carried at the inner end of the extension piece cannot seal with the resultant loss of fluid pressure.

The invention also includes a self-advancing, hydraulically powered mine roof support provided with one or more piston and cylinder units as hereinbefore defined.

Figure 2:
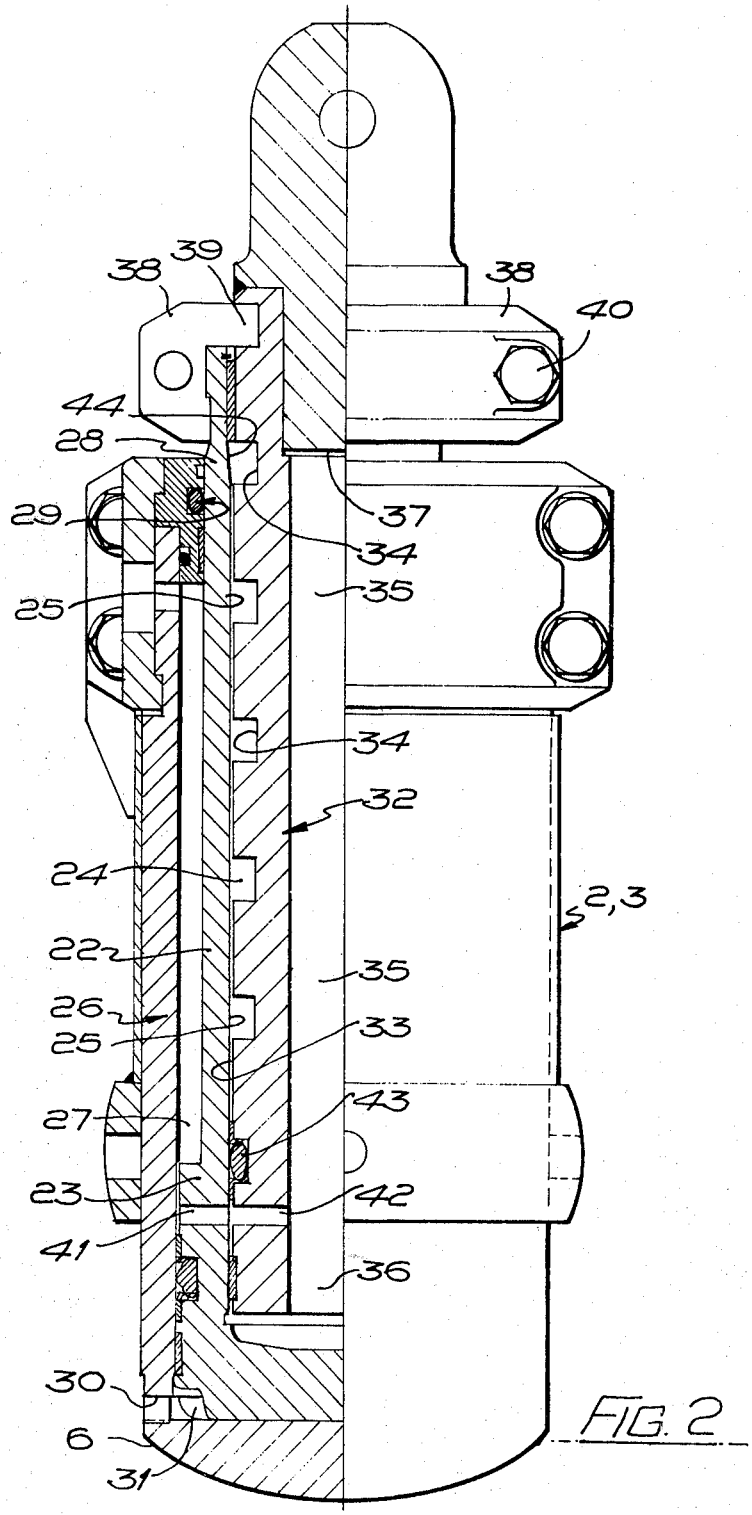

The invention will now be described by way of example with reference to the accompanying drawings, in which:

FIG. 1 is a side elevation of a self-advancing, hydraulically powered mine roof support in accordance with the invention; and FIG. 2 is a part sectional view along the longitudinal axis of one of the chock legs of FIG. 1.

The mine roof support 1 shown in FIG. 1 comprises, two spaced apart, hydraulically extensible, forward chock legs 2 and two spaced apart, hydraulically extensible, rearward chock legs 3, each leg 2, 3 being articulated at 4 to a roof beam 5 engageable with a mine roof 6 and articulated at 7 to a base member 8 seated on a mine floor 9. The roof beam 5 pivotally carries at its forward end a cantilever extension plate 10 which is urged into a roof engaging condition by a hydraulic pressure capsule 11 reacting on an abutment 12 attached to the roof beam 5. The base member 8 is provided at each lateral side thereof with a pair of links 13 attached to a shield element 14 articulated at an upper portion thereof to the roof beam 5. The base 8 is also provided with a central, double-acting hydraulic ram 15 provided at its forward end with a clevis member 16 attachable in the conventional manner to the usual clevis rail indicated at 17, carried by a spill plate assembly 18 attached to one sidewall 19 on a pan 20 of an armoured flexible conveyor extending along the mineral face beyond sidewall 21, the ram 15 being actuable in the conventional manner to advance its pan 20 and the roof support 1.

As detailed in FIG. 2, each chock leg 2, 3 comprises a hollow piston rod 22 having a piston head 23, a hollow interior 24 and an internal periphery 25. The piston rod 22 is slidably located within a cylinder 26 and together they define an annulus chamber 27, the piston rod 22 projecting from the cylinder at 28 beyond sealing means 29 carried by the cylinder 26. A tapped hole 30 provides for attachment of a hose connector (not shown) for the admission and exhaust of pressure fluid to and from a chamber 31 at the full bore side of the piston head 23, to displace the hollow piston rod 22 with respect to the cylinder 26.

The hollow piston rod 22 partially houses and thus includes an elongated extension piece 32 having a circular outer periphery 33 interrupted by a series of annular, and axially spaced, grooves 34. The extension piece 32 has a hollow interior 35, an open inner end 36 adjacent the piston head 23 and a plugged outer end 37. The extension piece 32 is mechanically connected to the hollow piston rod 22 by means of a collar 38 having an inwardly projecting annular flange 39, locatable in a selected groove 34, the collar 38 being releaseably secured in the locking position shown in FIG. 2 by bolts 40.

The piston head 23 is provided with a fluid passageway 41 connecting the annular chamber 27 with the interior 35 of the extension piece 32 via a fluid passageway 42 provided in the latter. A fluid seal 43 is provided in the outer periphery 33 of the extension piece 32 which seals against the internal periphery 25 of the hollow piston rod 22, the seal 43 being located between the passageway 41 and the outer projection 28 of the hollow piston rod 22. The internal periphery 25 has in the vicinity of the outer projection 28 a portion 44 of increased diameter such that the seal 43 will not be effective should it be brought opposite the portion 44.

In use, should it be found that it is required to effectively lengthen or shorten the piston rod 22, that is extend or retract the extension piece 32 of the piston rod from its previously selected position in the hollow piston rod 22, e.g. as may be dictated by diverging or converging roof conditions usually determined by variations in the thickness of a mineral seam being mined, the collar 38 is removed and pressure fluid admitted to the annulus chamber 27 if it is desired to extend the extension piece 32, or conversely, pressure fluid is removed from the annulus chamber 27 if it is required to retract the extension piece 32. As will be apparent from viewing FIG. 2, the fluid transfer between the chamber 27 and the passageway 41 takes place around the upper periphery (above the seal) of the piston 23. Initially from this point, the fluid directly flows through the passageway 42 to or from the hollow interior 35 an open inner end of the extension piece 32. When passageway 42 is not aligned with passageway 41, the fluid also follows the alternate path around the lower periphery of the extension piece 32 since this is below the seal 43. Once the lower end of the extension piece 32 clears the passageway 41, the fluid directly flows to or from the open inner end 36. When the extension piece 32 has been extended or retracted the desired amount, the collar 38 is re-applied to an adjacent appropriate groove 34. Thus, irrespective of the limitation of stroke between the hollow piston rod 22 and the cylinder 26, the provision and adjustability by power means of the extension piece 32 results in more rapid adjustment than was previously possible, with the consequent more rapid availability of the support for its roof supporting function, while by eliminating manual adjustment, the invention reduces operator fatigue and increases operator safety.

What I claim is:

1. A hydraulically actuable piston and cylinder unit comprising a housing forming a cylinder, a piston rod having a hollow interior defined by an internal periphery, a piston head provided on said piston rod and operatively positioned in said cylinder, an outer end of said piston rod located remotely from said piston head, an elongate extension piece having a circular outer periphery, slidably housed, at least partially in a chamber formed by said hollow interior in said piston rod, means to connect said extension piece to said piston rod at an outer end of said piston rod remote from said piston head, said means to mechanically connect said extension piece to said piston rod includes a plurality of outer peripheral grooves axially spaced along said extension piece, a collar removably secured to the outer end of said piston rod, an inwardly projecting flange on said collar for engaging a selected peripheral groove, thereby securely connecting and locking said extension piece in the extended position against movement in either direction, at least one fluid passageway communicating between an outer surface of said piston head and said chamber of said piston rod, and a fluid seal carried by said extension piece and sealing in said chamber against said internal periphery of said piston rod, the arrangement being such that said seal always lies between said fluid passageway and said outer end of said piston rod, whereby said extension piece may be extended to effectively lengthen said piston rod.

2. A hydraulically actuable piston and cylinder unit as claimed in claim 1, wherein said extension piece is hollow, and has an open inner end and a plugged outer end.

3. A hydraulically actuable piston and cylinder unit as claimed in claim 1, wherein said fluid passageway is located above the innermost point of entry of said extension piece, into said piston rod, with a passageway provided in a peripheral wall of said extension piece for initial fluid inlet and exhaust purposes.

4. A hydraulically actuable piston and cylinder unit as claimed in claim 1, wherein said chamber in said piston rod towards its outer end is of enlarged internal diameter, to an extent such that said seal carried by said extension piece will not seal, with the resultant loss of fluid pressure, thereby providing an upper limit of travel for said extension piece.

* * * * *